US008246404B1

(12) United States Patent
Sweet

(10) Patent No.: US 8,246,404 B1
(45) Date of Patent: Aug. 21, 2012

(54) SWIM FIN SYSTEM

(76) Inventor: Paul Joseph Sweet, Golden, CO (US)

( * ) Notice: Subject to any disclaimer, the term of this patent is extended or adjusted under 35 U.S.C. 154(b) by 331 days.

(21) Appl. No.: 12/475,998

(22) Filed: Jun. 1, 2009

Related U.S. Application Data

(60) Provisional application No. 61/057,309, filed on May 30, 2008.

(51) Int. Cl.
*A63B 31/12* (2006.01)

(52) U.S. Cl. ..... 441/60

(58) Field of Classification Search ..... 441/55, 441/60–64
See application file for complete search history.

(56) References Cited

U.S. PATENT DOCUMENTS

| | | | | |
|---|---|---|---|---|
| 1,260,931 | A * | 3/1918 | Melhus | 441/60 |
| 1,488,642 | A * | 4/1924 | Kjelgaard | 441/60 |
| 3,109,186 | A * | 11/1963 | Glenn | 441/60 |
| 3,286,287 | A * | 11/1966 | Martin | 441/57 |
| 4,981,454 | A | 1/1991 | Klein | |
| 5,338,235 | A * | 8/1994 | Lee | 441/59 |
| 5,632,662 | A | 5/1997 | Cadorette | |
| 6,182,377 | B1 * | 2/2001 | Toensing | 36/8.1 |
| 6,540,574 | B2 | 4/2003 | Hashizume et al. | |
| 6,672,920 | B2 | 1/2004 | Wilson | |
| 6,881,113 | B2 | 4/2005 | Smith | |
| 7,040,942 | B1 * | 5/2006 | Houck | 441/60 |
| 7,140,937 | B2 | 11/2006 | Cadorette | |
| 7,285,030 | B1 * | 10/2007 | Houck et al. | 441/60 |
| 2007/0167094 | A1 | 7/2007 | Moyal | |
| 2007/0167095 | A1 | 7/2007 | Moyal | |

* cited by examiner

*Primary Examiner* — Daniel Venne
(74) *Attorney, Agent, or Firm* — Holland & Hart LLP

(57) ABSTRACT

A swim fin system that may be used to propel an individual through water. The swim fin system may include a leg securement device, with an upper and a lower end, effective for detachably securing to at least the lower leg of an individual. A fin may attach longitudinally to the leg securement device where at least a portion of the fin is oblique to the leg securement device. The swim fin system may further include a second securement device, with an ankle end and a toe end, effective for detachably securing to at least the foot and ankle of an individual.

20 Claims, 5 Drawing Sheets

SWIM FIN SYSTEM

CROSS-REFERENCE TO RELATED APPLICATIONS

This application claims priority of U.S. Provisional Patent Application No. 61/057,309, filed May 30, 2008, which is incorporated by reference as if fully recited herein.

TECHNICAL FIELD

Exemplary embodiments are directed to human-powered water propulsion. In particular, exemplary embodiments are directed to a swim fin system.

BACKGROUND

For years, swimmers and divers have used different types of apparatus to increase the speed at which swimmers and divers move through the water. However, many of these apparatuses are heavy to carry, such as motor-powered systems. Other apparatuses may make it difficult for an individual to maneuver outside the water. Specifically, the common swim fin may cause undue hardship for an individual when they try to walk on surfaces such as a beach, a boat deck, a swimming pool deck, etc. Many times, common swim fins are arduous for individuals to walk forwards in because of the swim fins' extended toe area. Typically, to get around this problem, individuals have to walk forward with high-kneed steps, or individuals have to walk backwards. Both of these alternatives may be uncomfortable or arduous for some individuals; especially elderly and young individuals because they customarily have inferior balance.

In some situations, to combat the difficulty of walking, swimmers and divers may wait until they are in the water to put on their swim fins. However, much like walking on land, the task of putting on swim fins in the water may be difficult and arduous. If the water is deep enough so the swimmer or diver is unable to breath while touching the ground, the task of putting on swim fins may be exponentially more difficult. Nonetheless, swim fins and other water-propulsion devices are popular among swimmers and divers because they increase the propulsion of the swimmer and divers through the water.

Thus, it may be desired for swim fin system that allows individuals to walk on land or boats with less hardship than common swim fins. Additionally, exemplary embodiments of the swim fin system may allow an individual to attach the swim fins with relative ease. Also, exemplary embodiments of the system may improve a swimmer or diver's propulsion through the water.

SUMMARY

Exemplary embodiments of a swim fin system may be used to propel an individual through water. In an exemplary embodiment, the swim fin system includes a leg securement device, with an upper and a lower end, effective for detachably securing to at least the lower leg of an individual. A fin may attach longitudinally to the leg securement device where at least a portion of the fin is oblique to the leg securement device.

In another exemplary embodiment, the swim fin system may include a second securement device, with an ankle end and a toe end, effective for detachably securing to at least the foot and ankle of an individual. Furthermore, the system may include a second fin attached towards the ankle end of the second securement device.

In some exemplary embodiments, the first securement device may be detachably secured to at least an individual's lower leg. In some embodiments, the first securement device may include a closure device to facilitate attachment to the individual.

In additional exemplary embodiments, the second securement device may be detachably secured to at least the foot and ankle of an individual. In some embodiments, the second securement device may include a second closure device to facilitate attachment to the individual.

While certain embodiments of the present invention are described in detail herein, the scope of the invention is not to be considered limited by such disclosure, and modifications are possible without departing from the spirit of the invention.

BRIEF DESCRIPTION OF THE DRAWINGS

Other aspects of the present invention will be readily apparent from the following descriptions of the drawings and exemplary embodiments, wherein identical reference numerals refer to identical parts, and wherein.

DETAILED DESCRIPTION OF EXEMPLARY EMBODIMENT(S)

Figure 1:
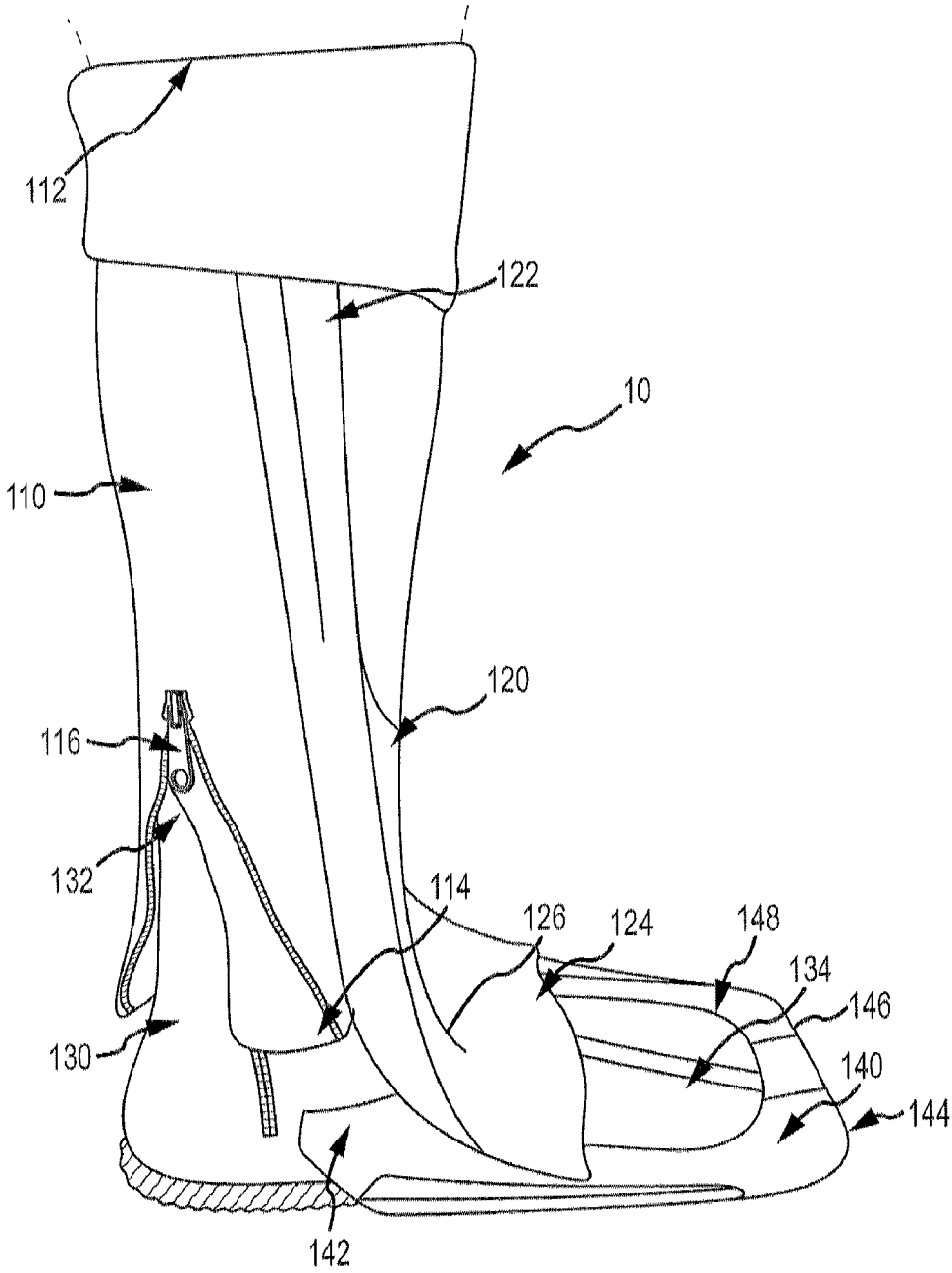
FIG. 1 is a right side elevation view of an exemplary embodiment of the swim fin system.

FIG. 1 depicts one exemplary embodiment of a swim fin system. As shown, this particular swim fin system 10 (hereinafter "system") includes a leg securement device 110, with an upper end 112 and a lower end 114, effective for detachably securing to at least the lower leg of an individual, and a fin 120 attached longitudinally to the leg securement device 110 where at least a portion of the fin is oblique to the leg securement device 110.

Figure 2:
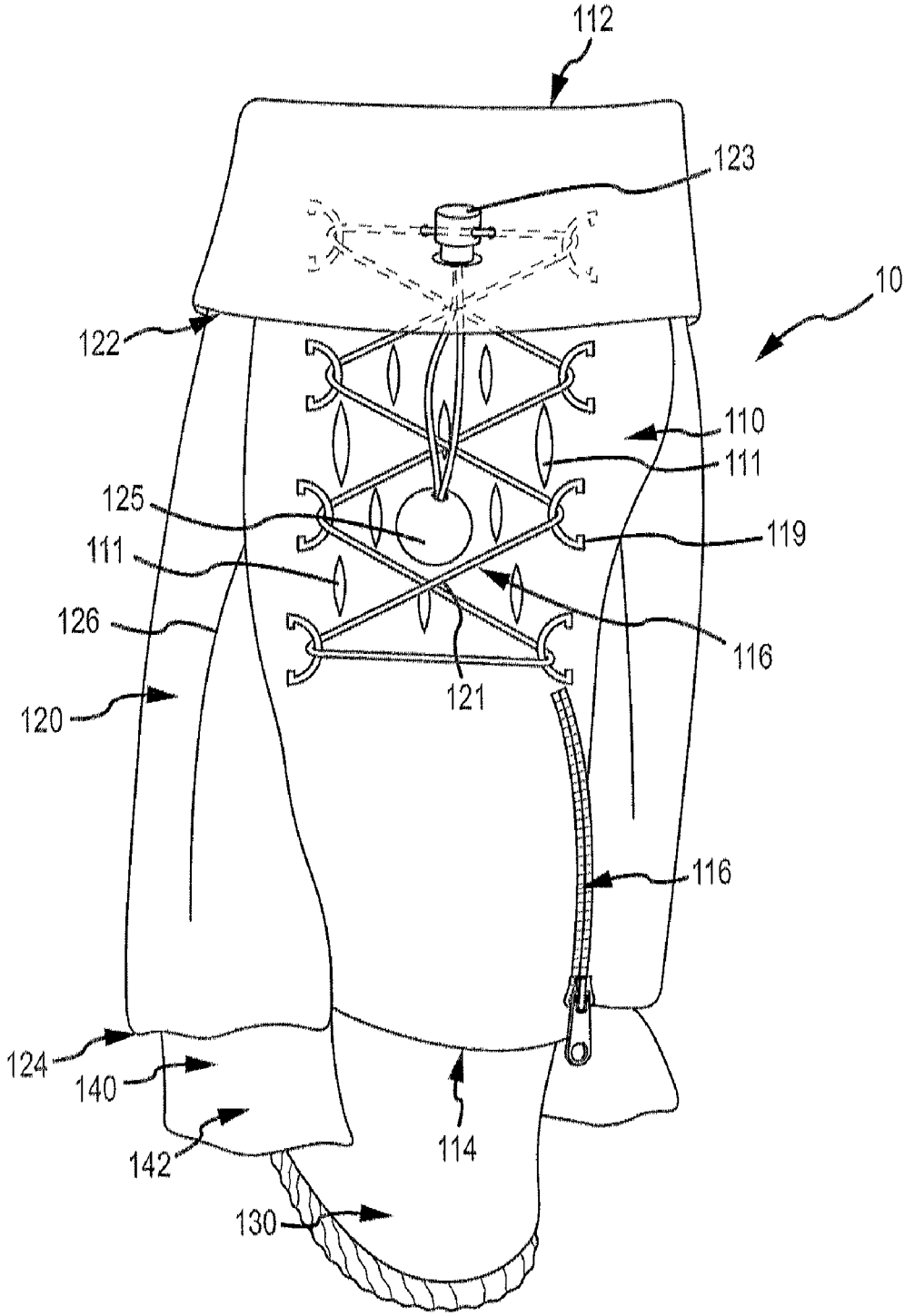
FIG. 2 is a back side elevation view of an exemplary embodiment of the swim fin system.

In this particular embodiment, the leg securement device 110 is an elastic sleeve. However, in other embodiments, the leg securement device may be any number of devices that may detachably secure to at least an individual's lower leg. In some embodiments, the elastic sleeve is designed to snugly fit on an individual from approximately four inches above the knee down to the ankle. However, depending on design characteristics and other needs, other exemplary embodiments the leg securement device 110 may cover any number of areas of an individual's legs. Furthermore, in exemplary embodiments, the sleeve or other leg securement device 110 may include at least one aperture 111 (as seen in FIG. 2) to allow the leg securement device 110 to accommodate larger calves of individuals by allowing the sleeve to expand at the desired area.

Although the leg securement device 110 is an elastic sleeve in this particular embodiment, any number of materials, individually or in combination, may be used to fabricate the leg securement device, including, but not limited to: metals, plastics, elastomers, fiberglass, etc. In one particular embodiment, the leg securement device may be fabricated from neoprene. Whatever the material used to fabricate the leg securement device 110, it is preferred that the material allows the leg securement device 110 to detachably secure to an individual. Additionally, it is preferred that the material is water-resistant so that the leg securement device 110 does not obtain additional weight when the leg securement device 110 is immersed in water during use. It is also preferred that at least the material that may come in contact with an individual's skin is not made from a material that commonly causes skin irritation. Furthermore, it may be preferred that the material used for the leg securemnent device 110 is resistant to corrosion from saltwater, as the system may be used in saltwater applications, such as the ocean.

Furthermore, in some exemplary embodiments, the leg securement device 110 may be attached to or integral with apparel that covers a larger portion of an individual. In one example, the leg securement device 110 may be attached to or integral with a dive wetsuit. In another example, the leg securement device may be attached to or integral with pants or other apparel that may secure to the lower portion of an individual. In whatever embodiment, it is preferred that once the leg securement device 110 detachably secures to at least the lower leg of an individual, the leg securement device 110 minimizes the movement of the system 10 relative to the movement of at least the lower leg of an individual.

A closure device 116 may be included in some exemplary embodiments of the leg securement device 110. This particular embodiment includes a zipper as the closure device 116. However, in other exemplary embodiments of the system 10, the closure device 116 may include, but is not limited to: snap fasteners, buttons with corresponding receiving slots, a hook and loop system, a lacing system, and adhesives. In some exemplary embodiments, the zipper may include a portion of material attached to one side of the zipper's tape to prevent the zipper from rubbing against an individual's leg during use thereof. In other exemplary embodiments, the portion of material may attach to both sides of the zipper's tape. Although the portion of material has been described in conjunction with exemplary embodiments that use a zipper as a closure device 116, other exemplary embodiments of the system that use other types of closure devices may include a portion of material.

Although the closure device 116 is located toward the lower end 114 of the leg securement device 110 in this embodiment, the closure device 116 may be located at any number of locations in other embodiments. For example, the closure device 116 may be located towards the upper end of the leg securement device 110. In another example, the leg closure device 116 may be located along the length of the leg securement device 110, from the upper end 112 to the lower end 114. Furthermore, the leg securement device may include more than one closure device 116, depending on design considerations and other factors. In this particular embodiment, the zipper has a closed end and an open end, wherein the open end is positioned at the lower end 114 of the leg securement device 110.

As best seen in FIG. 2, an additional closure device may be included as a lacing system may be located on the rear face of the leg securement device 110 that includes multiple restraining devices 119 that affix to the leg securement device 110. Exemplary embodiments of the system 10 may include multiple closure devices 116, as best seen in FIG. 2. In other embodiments, the second closure device 116 may be located any various other locations on the leg securement device 110. In this particular example, the restraining devices 119 are D-rings. However, in other exemplary embodiments the restraining devices 119 may be other forms of devices that allow proper operation of the lacing system. The restraining devices may be fabricated from various materials that are resistant to chlorine and other pool chemicals. Some examples of materials include, but not limited to: metals, plastics, fiberglass, etc.

The lacing system may further include a lacing device 121. In this particular embodiment, the lacing device 121 is an elastic cord, such as a bungee cord, that allows for increased tension during securement of the lacing system. Furthermore, the lacing system may include a spring-loaded cinch clip 123 that may draw the lacing device 119 tight and help secure the system 10 to an individual's leg. In this particular embodiment, the cinch clip 123 is located towards the upper end 112 of the neoprene sleeve, wherein a portion of the neoprene sleeve is folded over and the cinch clip 123 is located on the exterior of the folded portion. The lacing system may also include a retaining device 125 located at one end of the lacing device 121 to facilitate securement of the lacing system during use thereof. In one exemplary embodiment, the retaining device 125 is a plastic sphere. In other embodiments, the retaining device 125 may have different geometries and sizes that allow proper operation of the lacing system.

In this particular embodiment, a fin 120 may be attached longitudinally to the leg securement device 110 where at least a portion of the fin 120 is oblique to the leg securement device 110. In this exemplary embodiment, the entire fin 120 is oblique to the leg securement device 110. However, in other embodiments, only a portion of the fin 120 may be oblique to the leg securement device 110. In one particular example, at least a portion of the bottom end 124 may traverse away from the leg securement device 110 at a different angle relative to the remainder of the fin 120.

The fin 120 of this embodiment is substantially flat, with a width of fin 120 approximately six inches at a top end 122 and broadening to approximately eight inches at the bottom end 124. Other embodiments of the fin 120 may have any number of widths, depending upon the size of the individual the system 10 is designed to fit. For example, typically a fin 120 will have a larger width for a large adult, when compared with a small youth. Additionally, in other embodiments, the width of the fin 120 may stay substantially the same width from the top end 122 to the bottom end 124. Preferably, the thickness of the fin 120 allows for proper operation by allowing the fin 120 to flex during use thereof. Depending on the size of the individual the system 10 is designed to fit, the length of the fin 120 may vary. In some embodiments, vertical ribs 126 may run longitudinally along the fin 120 to facilitate catching and directing water flow. Other embodiments may use other geometries of ribs or other raised surfaces, depending on the desired direction of water flow.

In this particular embodiment, the fin 120 is attached longitudinally to the leg securement device 110 in a fashion such that the sleeve runs transversely through the top end 122 of the plane of the fin 120 with approximately one inch of the fin surface to the instep of the calf or shin of an individual, and one inch of surface on the outside of the calf or shin of an individual. When attached to the leg securement device, the top end 122 of the fin is situated towards the upper end 112 of the leg securement device, and the bottom end 124 is secured towards the lower end 114 of the leg securement device. The fin 120 may extend down past the lower end 114 of the leg securement device in some embodiments. Furthermore, in some exemplary embodiments, the lower end 114 of the fin may be more flexible than the rest of the fin 120 to improve the walking capability of an individual when the system is in use.

The fin 120 of this particular embodiment was fabricated from a combination of flexible plastic and a rubber and silicone combination. However, in other embodiments, the fin 120 may be fabricated from any number of materials, individually or in combination, including, but not limited to: metals, plastics, elastomers, fiberglass, etc. Whatever the material used, it may be preferred that the material has sufficient strength to withstand the cyclic stress found during use of the system 10. Preferably the fin 120 is fabricated from a material that is water-resistant so that the fin 120 does not obtain additional weight when immersed in water during use. Furthermore, it may be preferred that the material used for the fin 120 is resistant to corrosion from saltwater, as the system may be used in saltwater applications, such as the ocean. As some exemplary embodiments of the system may be used in chlorinated water, it may be preferred that some embodiments of the fin 120 are resistant to chlorine.

Figure 4:
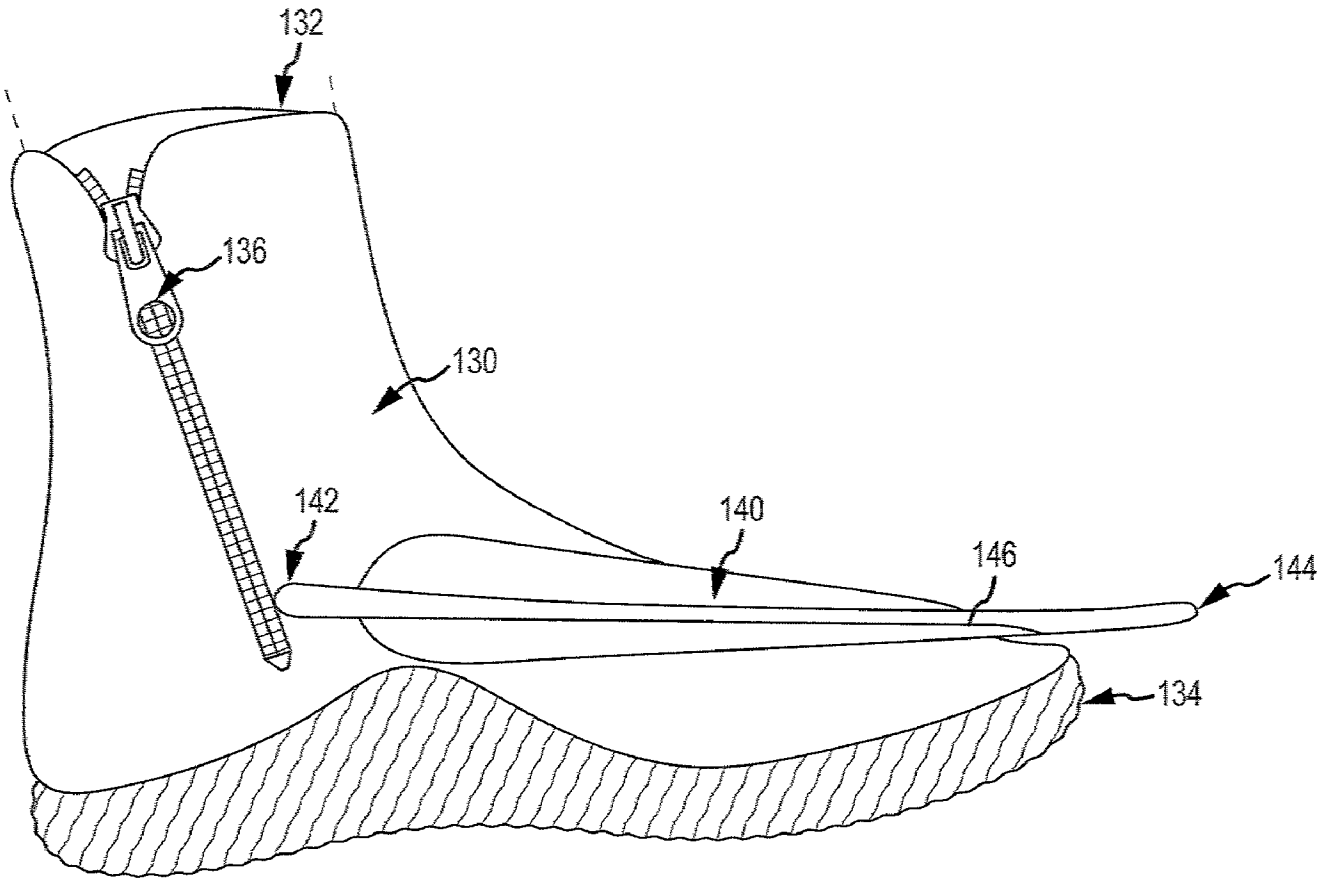
FIG. 4 is a right side elevation view of an exemplary embodiment of a second leg securement device.

FIG. 4 depicts another exemplary embodiment of a swim fin system that includes a second securement device 130 with an ankle end 132 and a toe end 134, effective for detachably securing to at least the foot and ankle of an individual, and a second fin 140 attached towards the ankle end 132 of the second securement device 130.

In this particular embodiment, the second leg securement device 130 is a dive boot. However, in other embodiments, the second leg securement device 130 may be any number of devices that may detachably secure to at least an individual's foot and ankle. In some embodiments, the dive boot may be designed to snugly fit on an individual to approximately four inches above the ankle. However, depending on design characteristics and other needs, other exemplary embodiments the second leg securement device 130 may cover any number of areas of an individual's lower leg and/or foot area.

Any number of materials, individually or in combination, may be used to fabricate the second leg securement device 130, including, but not limited to: metals, plastics, elastomers, fiberglass, silicone, etc. In this particular embodiment, the dive boot is fabricated from neoprene. Whatever the material used to fabricate the second leg securement device 130, it is preferred that the material allows the second leg securement device 130 to detachably secure to an individual. Additionally, it is preferred that the material is water-resistant so that the second leg securement device 130 does not obtain additional weight when the second leg securement device 130 is immersed in water during use. It is also preferred that at least the material that may come in contact with an individual's skin is not made from a material that commonly causes skin irritation. Furthermore, it may be preferred that the material used for the second leg securement device 130 is resistant to corrosion from saltwater or chlorine, as the system may be used in saltwater or chlorinated water applications, such as the ocean and a common swimming pool. In some embodiments, the bottom surface of the second leg securement device 130 may be fabricated from a material that is wear-resistant that promotes longer life of the system.

Figure 6B:
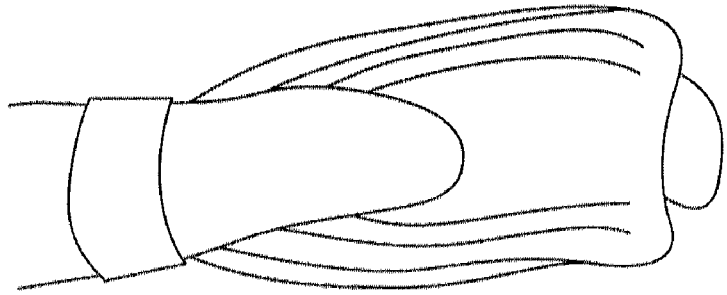
FIG. 6 is an exploded view of an exemplary embodiment of a swim fin system secured to a wetsuit.
Figure 6A:
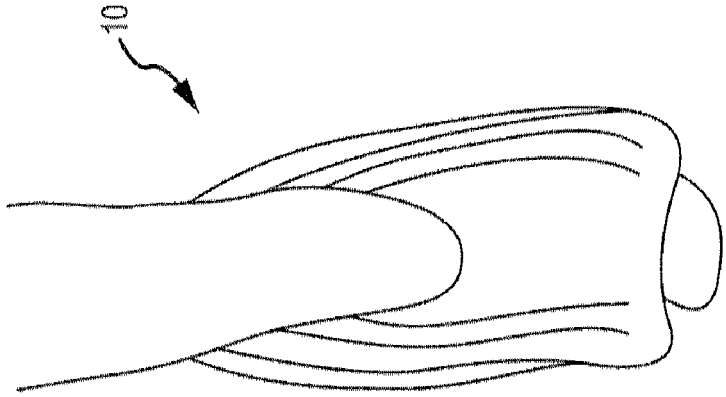
Figure 5:
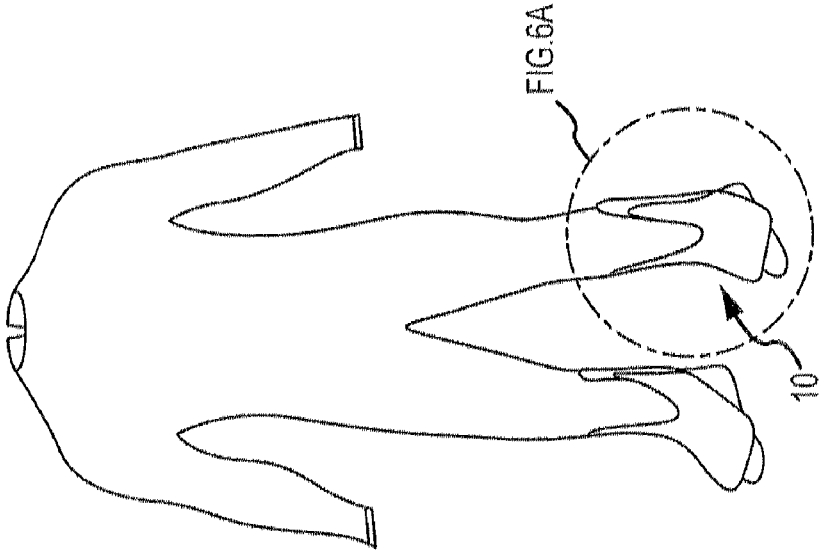
FIG. 5 is a perspective view of an exemplary embodiment of a swim fin system secured to a wetsuit.

The second leg securement device 130 may be attached to or integral with apparel that covers a larger portion of an individual. Additionally, in some embodiments, the second leg securement device may be attached to or integral with the first leg securement device 110. In one example, the second leg securement device 130 may be attached to or integral with a dive wetsuit, as best seen in FIGS. 5 and 6. In another example, the second leg securement device 130 may be attached to or integral with pants or other apparel that may secure to the lower portion of an individual. In whatever embodiment, it is preferred that once the second leg securement device 130 detachably secures to at least the foot and ankle of an individual, the second leg securement device 130 minimizes the movement of the system 10 relative to the movement of at least the ankle and foot of an individual to increase propulsion. Also, minimizing the movement of the second leg securement device 130 may decrease the likelihood of an individual acquiring blisters from the device rubbing against the individual's skin.

A second closure device 136 may be included in some exemplary embodiments of the second leg securement device 130. This particular embodiment includes a zipper as the second closure device 136. However, in other exemplary embodiments of the system 10, the second closure device 136 may include, but is not limited to: snap fasteners, buttons with corresponding receiving slots, a hook and loop system, a lacing system, and adhesives. In some exemplary embodiments, the zipper may include a portion of material attached to one side of the zipper's tape to prevent the zipper from rubbing against an individual's leg during use thereof. In other exemplary embodiments, the portion of material may attach to both sides of the zipper's tape. Although the portion of material has been described in conjunction with exemplary embodiments that use a zipper as a second closure device 136, other exemplary embodiments of the system that use other types of closure devices may include a portion of material.

In this particular embodiment, the second closure device 136 is located toward the ankle end 132 of the second leg securement device 130. However, the second closure device 136 may be located at any number of locations on the second leg securement device 130, in other embodiments. For example, the closure device 136 may be located towards the toe end of the second leg securement device 130. In another example, the second leg closure device 136 may be located along the length of the second leg securement device 130, from the ankle end 132 to the toe end 134. Furthermore, the second leg securement device 130 may include more than one closure device 136, depending on design considerations and other factors. In this particular embodiment, the zipper has a closed end and an open end, wherein the open end is positioned at the ankle end 132 of the second securement device 130.

In this particular embodiment, a second fin 140 may be attached to at least a portion of the top surface and the left and right side of the second securement device 130. In this exemplary embodiment, the second fin 140 extends from the ankle end 132 substantially horizontally past the toe end 134 by one to two inches. However, in other embodiments, the second fin 140 may not extend past the toe end 134 or may extend past the toe end 134 by more than one to two inches.

The second fin 140 of this embodiment is substantially flat, with a constant width of approximately eight inches from a proximal end 142 to the distal end 144. Other embodiments of the second fin 140 may have any number of widths, depending upon the size of the individual the system 10 is designed to fit. For example, typically the second fin 140 will have a larger width for a large adult, when compared with a small youth. Additionally, in other embodiments, the width of the second fin 140 may vary in width from the proximal end 142 to the distal end 144. Preferably, the thickness of the second fin 140 allows for proper operation by allowing the second fin 140 to flex, yet retain enough rigidity to promote proper operation of the system 10. Depending on the size of the individual the system 10 is designed to fit, the length of the second fin 140 may vary. In some embodiments, vertical ribs 146 located on either the top or bottom surface may run longitudinally along the second fin 140 from the proximal end 142 to the distal end 144 to facilitate catching and directing water flow. In the embodiment illustrated in FIG. 1, the vertical ribs 146 are situated at the outer edge of the upper and lower surface of the second swim fin 140. Other embodiments may use other geometries of ribs or other raised or lowered surfaces, depending on the desired direction of water flow.

When attached to the second leg securment device 130, the proximal end 142 may be situated towards the ankle end 132 of the second leg securement device, and the distal end 144 may be secured towards the toe end 134. The fin 120 may extend down past the toe end 134 of the leg securement device in some embodiments. Typically, exemplary embodiments of the second swim fin 140 includes an aperture 148 that is adapted to facilitate attachment of the second swim fin 140 to the second leg securement device 130. In this particular embodiment, the sides of the aperture 148 attach to the sides of the second leg securement device. However, in other embodiments, the distal end of the aperture 148 may attach to the front face of the second leg securement device 130.

The second fin 140 of this particular embodiment was fabricated from a combination of flexible plastic and a rubber and silicone combination. However, in other embodiments, the second fin 140 may be fabricated from any number of materials, individually or in combination, including, but not limited to: metals, plastics, elastomers, fiberglass, etc. Whatever the material used, it may be preferred that the material has sufficient strength to withstand the cyclic stress found during use of the system 10. Preferably the second fin 140 is fabricated from a material that is water-resistant so that the second fin 140 does not obtain additional weight when immersed in water during use. Furthermore, it may be preferred that the material used for the second fin 140 is resistant to corrosion from saltwater, as the system may be used in saltwater applications, such as the ocean. As some exemplary embodiments of the system may be used in chlorinated water, it may be preferred that some embodiments of the second fin 140 are resistant to chlorine.

Figure 3:
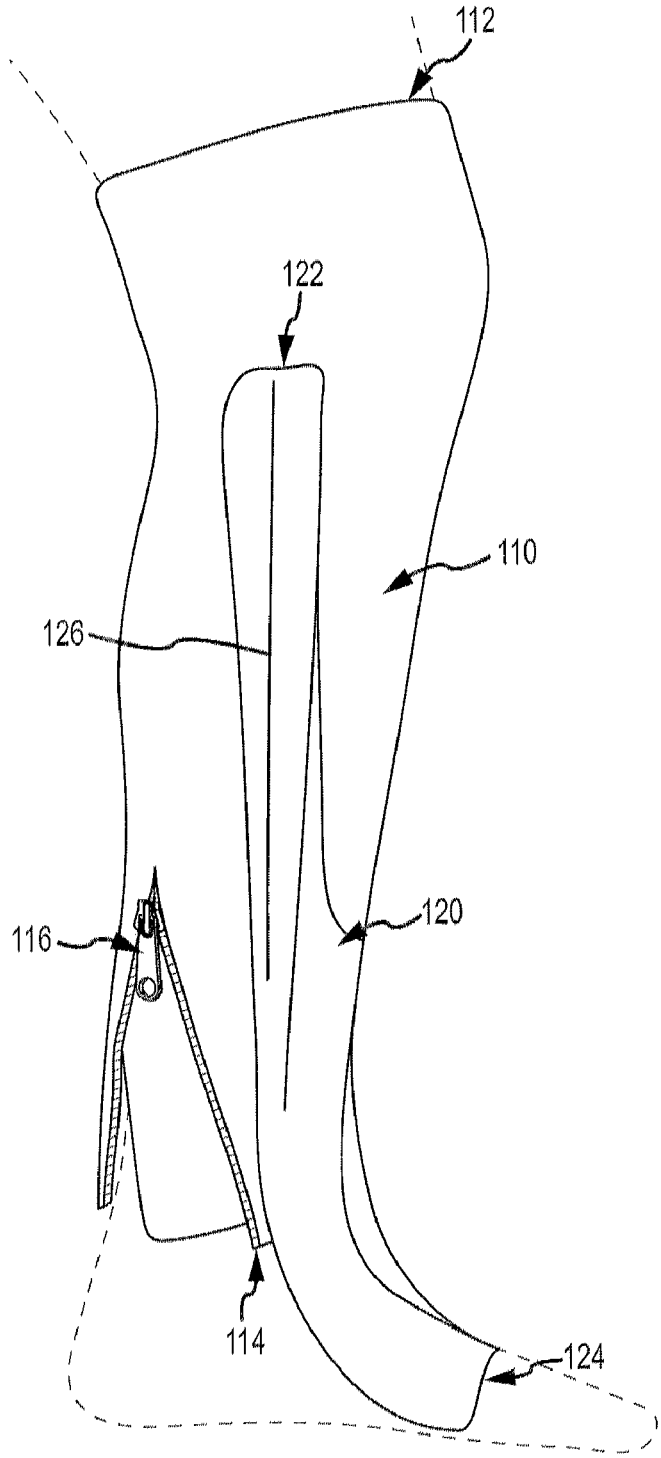
FIG. 3 is a right side elevation view of an exemplary embodiment of a leg securement device secured to an individual's leg.

During use of the exemplary embodiment, as best seen in FIG. 3, an individual may affix the sleeve and fin by sliding the sleeve over the foot and up the leg until the sleeve engages the leg of an individual. The sleeve may be held in place by the friction created between the elastic sleeve and the individual's leg. Furthermore, in exemplary embodiments the include a closure device, the individual may engage the closure device for improved securement to an individual's leg. Ideally, the individual may situate the sleeve and fin so that the top end of the fin begins just below the knee and extends down past the end of the elastic sleeve and partially over an individual's foot. Typically, an individual will affix a first securement device and fin to each leg.

After arranging the first securing device and fin, and individual may secure the second securement device and second fin, in those embodiments that include these additional components. In embodiments that include the second securement device and fin, an individual may slide their foot into the boot or equivalent device. Similar to the first securement device, the second securement device may be held in place by the friction created between the boot and the individual's foot and ankle. Also, to improve securement to an individual's leg, the second closure device may be engaged in those embodiments that contain a second closure device. Typically, an individual will affix a second securement device and fin to each foot and ankle. In some exemplary embodiments, each second securement device and fin are adapted to affix to either the left or right foot and ankle of an individual.

When installed and in use, exemplary embodiments of the combined components may direct water down the first fin and across the second fin to provide increased propulsion for an individual. However, when compared with traditional dive fins, the individual should be able to walk more naturally and safely on a boat, shore or other surface. Although an individual will typically wear both the first securement device and fin and the second securement device and fin, each of the components may be worn separately for activities, such as, but not limited to: snorkeling, exercising, etc. Generally, propulsion provided by each component separately will not be as significant as when the components are combined. Also, if desired, the first securement device and fin may be worn in combination with a traditional fin to provide even greater propulsion, in some exemplary embodiments.

What is claimed is:

1. A swim fin system comprising:
   - a leg securement device, with an upper end and a lower end, for detachably securing to at least the lower leg of an individual;
   - a fin attached to the leg securement device along a length thereof where at least a portion of the fin is oblique to the length of the leg securement device, wherein the fin includes a bottom end portion proximate the lower end of the leg securement device angled away from the oblique portion;
   - a boot, with an ankle end and a toe end, for detachably securing to at least the foot and ankle of an individual; and
   - a second fin attached proximate the ankle end of the boot and extending towards the toe end, wherein the boot has a bottom surface and the second fin is located entirely above the bottom surface.

2. The system of claim 1, wherein the leg securement device is a sleeve.

3. The system of claim 1, further comprising a closure device affixed to the leg securement device.

4. The system of claim 3, wherein the closure device is a zipper.

5. The system of claim 3, wherein the closure device is a lacing system.

6. The system of claim 1, wherein at least one rib runs along a length of the fin.

7. The system of claim 1, wherein the second fin extends from the ankle end horizontally past the toe end.

8. The system of claim 1, wherein the second fin includes a plurality of ribs.

9. The system of claim 1, wherein the boot includes a second closure device.

10. The system of claim 1, wherein the bottom end portion extends across the front of the leg securement device.

11. A swim fin system comprising:
   - a sleeve, with an upper end and a lower end, for detachably securing to at least the lower leg of an individual;
   - at least one closure device affixed to the sleeve;
   - a fin attached to the leg securement device along a length thereof where at least a portion of the fin is oblique to the length of the leg securement device, wherein the fin includes a bottom end portion proximate the lower end of the leg securement device angled away from the oblique portion;
   - a boot, with an ankle end and a toe end, for detachably securing to at least the foot and ankle of an individual;
   - a second closure affixed to the boot; and
   - a second fin attached towards the ankle end of the boot, wherein the boot has a bottom surface and the second fin is located entirely above the bottom surface.

12. The system of claim 11, wherein the closure device is a zipper.

13. The system of claim 11, wherein the closure device is a lacing system.

14. The system of claim 11, wherein at least one rib runs along a length of the fin.

15. The system of claim 11, wherein the second fin includes a plurality of ribs.

16. The system of claim 11, wherein the second fin extends from the ankle end horizontally past the toe end.

17. The system of claim 16, wherein the second fin includes a plurality of ribs.

18. The system of claim 11, wherein the bottom end portion extends across the front of the leg securement device.

19. A swim fin system comprising:

a sleeve, with an upper end and a lower end, for detachably securing to at least the lower leg of an individual;

a zipper that is affixed to the sleeve;

a lacing system that is affixed to the sleeve;

a fin attached to the leg securement device along a length thereof where at least a portion of the fin is oblique to the length of the leg securement device wherein at least one rib runs along a length of the fin;

a boot, with an ankle end and a toe end, for detachably securing to at least the foot and ankle of an individual;

a closure device affixed to the boot; and a second fin attached to at least a portion of the boot, wherein the boot has a bottom surface and the second fin is located entirely above the bottom surface.

20. The system of claim 19, wherein the second fin extends from the ankle end horizontally past the toe end.

* * * * *